US012590724B2

(12) United States Patent
Tanabe et al.

(10) Patent No.: US 12,590,724 B2
(45) Date of Patent: Mar. 31, 2026

(54) AIR-CONDITIONING SYSTEM AND CONTROL DEVICE

(71) Applicant: Mitsubishi Electric Corporation, Tokyo (JP)

(72) Inventors: Chika Tanabe, Tokyo (JP); Yasuyuki Takai, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 455 days.

(21) Appl. No.: 18/261,167

(22) PCT Filed: Mar. 31, 2021

(86) PCT No.: PCT/JP2021/013921
§ 371 (c)(1),
(2) Date: Jul. 12, 2023

(87) PCT Pub. No.: WO2022/208767
PCT Pub. Date: Oct. 6, 2022

(65) Prior Publication Data
US 2024/0085046 A1 Mar. 14, 2024

(51) Int. Cl.
*F24F 11/56* (2018.01)

(52) U.S. Cl.
CPC ..... *F24F 11/56* (2018.01)

(58) Field of Classification Search
CPC .. F24F 11/62; F24F 11/58; F24F 11/54; F24F 11/56
See application file for complete search history.

(56) References Cited

U.S. PATENT DOCUMENTS 7,925,383 B2 * 4/2011 Kwon ..... G05B 19/042 700/19
2008/0236177 A1 * 10/2008 Senba ..... F24F 11/62 62/157

(Continued)

FOREIGN PATENT DOCUMENTS

JP 3821580 B2 9/2006
JP 2015-043189 A 3/2015
JP 2016-178615 A 10/2016

OTHER PUBLICATIONS

International Search Report of the International Searching Authority mailed Jun. 8, 2021 for the corresponding International Patent Application No. PCT/JP2021/013921 (and English translation).

*Primary Examiner* — Mohammad Ali
*Assistant Examiner* — Vincent W Chang
(74) *Attorney, Agent, or Firm* — Posz Law Group, PLC

(57) ABSTRACT

An air-conditioning system includes a second control device that is communicable with a first control device that controls a first system including a first air-conditioning device by first communication using a first communication protocol, to control a second system including a second air-conditioning device by second communication using a second communication protocol different from the first communication protocol, in which the second control device is communicable with the first control device by third communication using an XML communication protocol, acquires first control information from the first control device by the third communication, the first control information being used for controlling the first system, creates second control information based on the first control information acquired by the third communication, the second control information causing the second system to execute control corresponding to control of the first system.

8 Claims, 9 Drawing Sheets

(56) References Cited

U.S. PATENT DOCUMENTS

| | | | | |
|---|---|---|---|---|
| 2009/0139251 | A1* | 6/2009 | Masui | F24F 11/64<br>62/129 |
| 2015/0308702 | A1* | 10/2015 | Yabuta | F24F 11/63<br>700/276 |

* cited by examiner

AIR-CONDITIONING SYSTEM AND CONTROL DEVICE

CROSS-REFERENCE TO RELATED APPLICATION

This application is a U.S. National Stage Application of PCT/JP2021/013921 filed on Mar. 31, 2021, the contents of which are incorporated herein by reference.

TECHNICAL FIELD

The present disclosure relates to an air-conditioning system and a control device.

BACKGROUND

A large number of air conditioners are installed in buildings and large buildings such as large commercial facilities. When a plurality of air-conditioning devices is installed in one building in this manner, an air-conditioning system that integrally controls the plurality of air-conditioning devices using a control device called a system controller is provided.

In such an air-conditioning system, air-conditioning devices of different manufacturers may be provided in the same floor region. Each of the air-conditioning devices of these manufacturers is connected to a control device of a corresponding manufacturer via a network, and is integrally controlled by the control device of the manufacturer.

As such an air-conditioning system, there is a communication network repeater in which XML communication is executed between an own system controller and a system controller of another company, LON communication is executed between the own system controller and an air-conditioning device, and protocol conversion between LON communication and XML communication is executed (PTL 1).

PATENT LITERATURE

PTL 1: Japanese Patent Laying-Open No. 2016-178615

However, in the communication network repeater described in PTL 1 performs relaying such that communication using a general-purpose LON communication protocol is executed in the air-conditioning system of the own company, and that communication using a general-purpose XML communication protocol is executed between an air-conditioning system controller of the own company and a system controller of another company. Therefore, there is a possibility of a security problem that information regarding control used in the air-conditioning system of the own company may flow out into the air-conditioning system of another company using a general-purpose communication protocol such as the LON communication protocol and the XML communication protocol.

SUMMARY

An object of an air-conditioning system of the present disclosure is, between two air-conditioning systems executing communication using different communication protocols, to enable one air-conditioning system to execute control corresponding to control executed by the other air-conditioning system without causing a security problem.

The present disclosure relates to an air-conditioning system. An air-conditioning system includes: a second control device that is communicable with a first control device, the first control device being configured to control a first system including a first air-conditioning device by first communication using a first communication protocol, the second control device being configured to control a second system including a second air-conditioning device by second communication using a second communication protocol different from the first communication protocol, wherein the second control device: is communicable with the first control device by third communication using an XML communication protocol, acquires first control information from the first control device by the third communication, the first control information being used for controlling the first system, creates second control information based on the first control information acquired by the third communication, the second control information causing the second system to execute control corresponding to control of the first system executed according to the first control information, and controls the second system by the second communication based on the created second control information.

According to the air-conditioning system of the present disclosure, the first system is controlled by the first communication using the first communication protocol, the second system is controlled by the second communication using the second communication protocol, the first control information used for controlling the first system is acquired from the first control device by the third communication using the XML communication protocol, the second control information causing the second system to execute control corresponding to control of the first system executed according to the first control information is created based on the first control information acquired by the third communication, and the second system is controlled by the second communication based on the created second control information. Therefore, it is possible for one air-conditioning system to easily execute control corresponding to control executed by the other air-conditioning system without causing a security problem.

DETAILED DESCRIPTION

Figure 1:
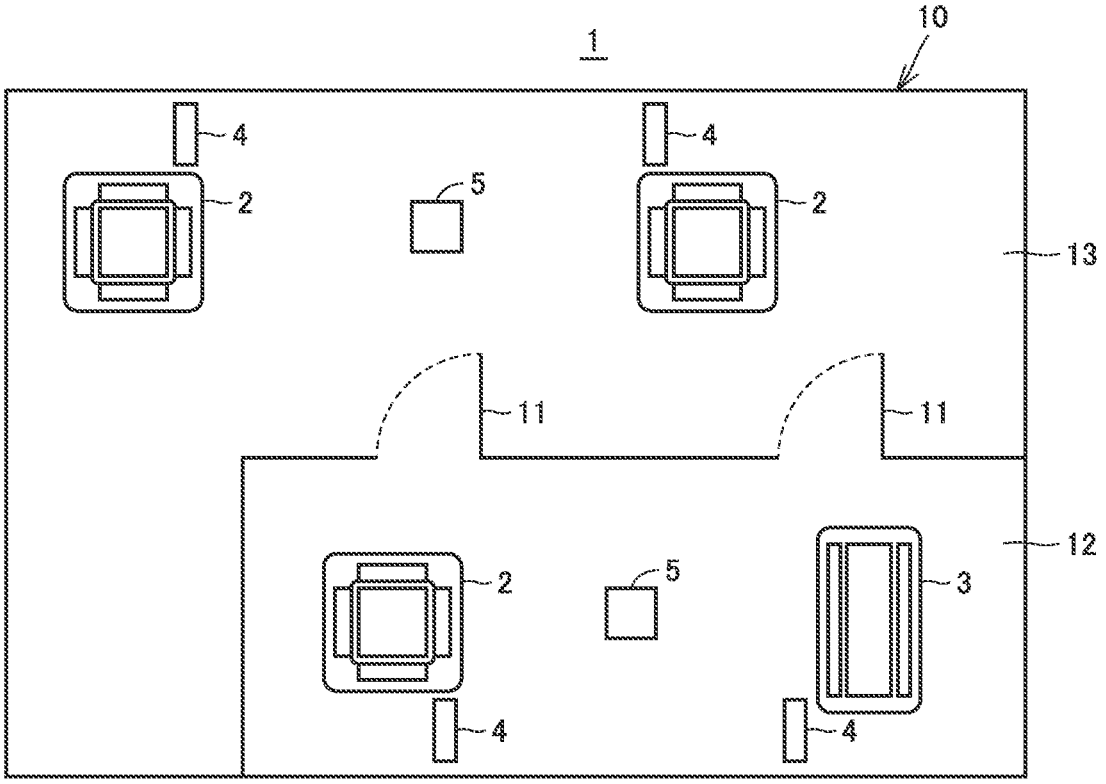
FIG. 1 is a plan view of a building 10 illustrating an arrangement of an air-conditioning system 1 according to a first embodiment.

Embodiments of the present disclosure will be described in detail with reference to the drawings. Hereinafter, a plurality of embodiments will be described, but it is planned from the beginning of the application that configurations described in the embodiments are appropriately combined. The same or corresponding parts in the drawings are denoted by the same reference numerals, and descriptions thereof will not be repeated.

First Embodiment

FIG. 1 is a plan view of a building 10 illustrating an arrangement of an air-conditioning system 1 according to an embodiment. FIG. 1 illustrates a state of arrangement of a first indoor unit 2, a second indoor unit 3, a remote controller 4, and a receiver 5 in air-conditioning system 1 provided in building 10. Specifically, in FIG. 1, first indoor unit 2, second indoor unit 3, and receiver 5 are provided on the ceiling, but first indoor unit 2 and second indoor unit 3 are indicated by icons of indoor units having shapes in which blowout ports are viewed from below in order to clarify positions of arrangement.

FIG. 1 illustrates a state of arrangement of a first indoor unit 2, a second indoor unit 3, a remote controller 4, and a receiver 5 in air-conditioning system 1 provided in building 10. Building 10 is provided with a private room 12 that can be accessed by opening a door 11, and a hall 13 outside private room 12. Private room 12 is provided with one first indoor unit 2 that is an indoor unit of another company and one second indoor unit 3 that is an indoor unit of own company. Two first indoor units 2 are provided in hall 13. The own company refers to a manufacturer that has manufactured a second system including second indoor unit 3. On the other hand, another company means a manufacturer that has manufactured a first system including first indoor unit 2. Another and other companies mean all manufacturers other than our company.

Private room 12 is provided with one receiver 5 and two remote controllers 4. Hall 13 is provided with one receiver 5 and two remote controllers 4. Each of remote controllers 4 in private room 12 and hall 13 is detachably held by a remote controller holder provided on a wall, for example. Remote controller 4 is a transmitter that allows a person to perform an operation for instructing an operation state of air-conditioning system 1 based on wireless communication such as infrared communication. For example, when an operation unit provided in remote controller 4 is operated, remote controller 4 transmits an operation signal corresponding to the operation. Receiver 5 receives the signal transmitted from remote controller 4, and transmits the received signal to a first system controller 6 illustrated in FIG. 2.

Each remote controller 4 is provided with a predetermined sensor such as a temperature sensor that detects room temperature, for example. Each remote controller 4 transmits a signal indicating detection data of the temperature of an area in which each remote controller 4 is located by wireless communication at a constant cycle. As described above, each remote controller 4 outputs a signal indicating the detection data of the sensor in addition to the operation signal. Note that each remote controller 4 may be provided with, as a sensor, a sensor of various types for detecting parameters that can be used for control of the air-conditioning system, such as a humidity sensor, in addition to a temperature sensor.

Figure 2:
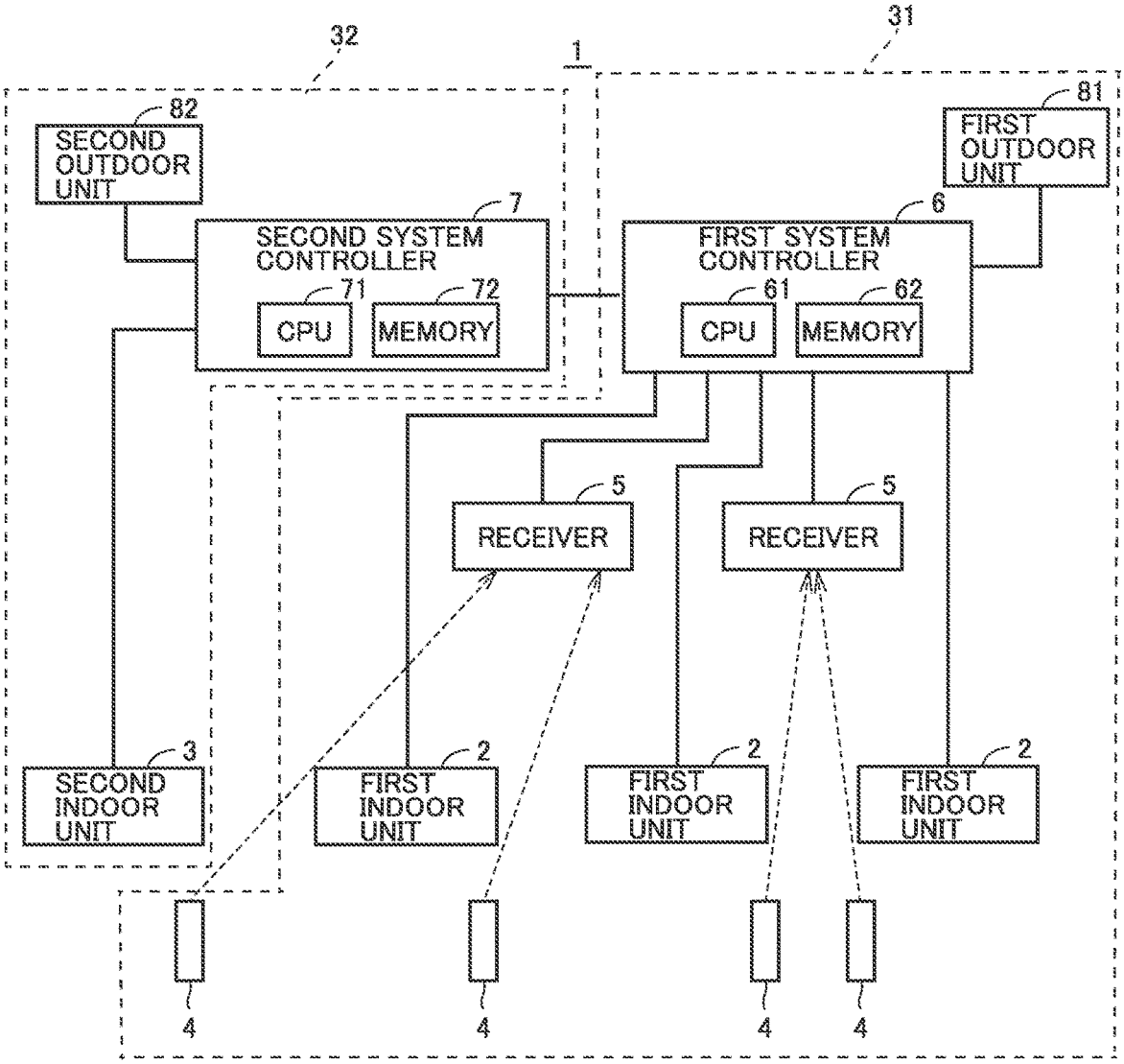
FIG. 2 is a block diagram of air-conditioning system 1 according to the first embodiment.

FIG. 2 is a block diagram of air-conditioning system 1 according to a first embodiment. In FIG. 2, a block diagram of air-conditioning system 1 illustrated in FIG. 1 is shown.

Referring to FIG. 2, air-conditioning system 1 includes a first system 31 configured by an air-conditioning device of another company and a second system 32 configured by an air-conditioning device of own company. First system 31 is controlled by a first system controller (hereinafter, it is abbreviated as a first SC) 6. Second system 32 is controlled by a second system controller (hereinafter, it is abbreviated as a second SC) 7.

First SC 6 includes a CPU (Central Processing Unit) 61, a memory 62 (a memory including a ROM (Read Only Memory), a RAM (Random Access Memory), and a non-volatile memory), and an input/output buffer (not shown) and the like for inputting and outputting various signals. In first SC 6, various electronic components are attached on a control board. The control board includes a plurality of input ports and a plurality of output ports used to output signals necessary for controlling first system 31, for example.

CPU 61 extracts programs stored in the ROM to the RAM or the like, and executes the programs. The programs stored in the ROM are programs in each of which a processing procedure of first SC 6 is described. CPU 61 executes control of each device in first system 31 according to these programs. The control is not limited to software processing, but can be processed by dedicated hardware (electronic circuit).

Second SC 7 includes a CPU 71, a memory 72, an input/output buffer for inputting and outputting various signals (not illustrated), and the like. In second SC 7, various electronic components are attached on a control board. The control board includes a plurality of input ports and a plurality of output ports used to output signals necessary for controlling second system 32, for example.

CPU 71 and memory 72 in second SC 7 perform operations similar to the operations of CPU 61 and memory 62 in first SC 6 described above.

First system 31 includes a first outdoor unit 81 and first SC 6, in addition to the plurality of first indoor units 2, the plurality of remote controllers 4, and the plurality of receivers 5 illustrated in FIG. 1. First SC 6 is connected to each of the plurality of first indoor units 2, the plurality of receivers 5, and first outdoor unit 81 by wire.

First SC 6 manages an operation state of each of first indoor units 2 and first outdoor unit 81 based on input of a signal indicating a control state such as a temperature detection value from each of first indoor units 2 and first outdoor unit 81. An operation signal and sensor detection data transmitted from remote controller 4 and received by receiver 5 are input to first SC 6 from receiver 5. First SC 6 can control first indoor units 2 and first outdoor unit 81 by transmitting a control signal to each of first indoor units 2 using the first communication protocol. The first communication protocol is a communication protocol unique to another company. As described above, in first system 31, first SC 6 controls first system 31 by the first communication using the first communication protocol unique to another company.

Second system 32 includes a second outdoor unit 82 and second SC 7 in addition to second indoor unit 3 illustrated in FIG. 1. Second SC 7 is connected to each of second indoor unit 3 and second outdoor unit 82 by wire.

Second SC 7 manages an operation state of each of second indoor unit 3 and second outdoor unit 82 based on input of a signal indicating a control state such as a temperature detection value from each of second indoor unit 3 and second outdoor unit 82. Second SC 7 can control second indoor unit 3 and second outdoor unit 82 by transmitting a control signal to each of second indoor unit 3 and second outdoor unit 82 using the second communication protocol. The second communication protocol is a communication protocol unique to own company.

Second SC 7 can perform XML communication with first SC 6 using the XML communication protocol, and acquires first control information used for controlling first system 31 by the XML communication. The first control information is, for example, information specifying a control mode during execution of first system 31, detection data by a sensor of remote controller 4, and information related to control of first system 31 such as an address of first SC 6 as a transmission source. In this manner, in second system 32, second SC 7 controls second system 32 by the second communication using the second communication protocol unique to own company.

In this manner, communication using the unique first communication protocol is executed in first system 31. In second system 32, communication with the unique second communication protocol different from the first communication protocol is executed. Communication in a general-purpose third communication protocol different from the first communication protocol and the second communication protocol is executed between first SC 6 and second SC 7.

The reason why the XML communication using the XML communication protocol is performed between second SC 7 and first SC 6 is as follows. XML is a language that is general and easy to define uniquely. Furthermore, languages used in the Internet line are roughly classified into HTML and XML. HTML is a language for screen display, and XML is a language for data description. In air-conditioning system 1 according to the present embodiment, a communication language mainly intended for data analysis and data use is required, and therefore the XML communication protocol using the XML language is used as a protocol for communication between second SC 7 and first SC 6. Note that communication using various general-purpose communication protocols other than the XML communication protocol may be executed for communication between second SC 7 and first SC 6. The reason why the general-purpose communication protocol is used is that, in a network related to data communication, a basic protocol in network communication is a general-purpose communication protocol, and the general-purpose communication protocol easily allows communication between various system controllers regardless of a manufacturer.

Second SC 7 performs XML, communication as the third communication using the general-purpose XML communication protocol with first SC 6 of first system 31, and controls second system 32 by the second communication using the second communication protocol unique to own company in second system 32.

Second SC 7 creates second control information for causing second system 32 to execute control corresponding to control of first system 31 executed according to the first control information based on the first control information acquired from first SC 6 by XML communication as the third communication, and controls second system 32 by the second communication using the second communication protocol based on the created second control information. As a result, second system 32 can cause second system 32 to execute the control corresponding to the control of first system 31 executed according to the first control information based on the second control information created based on the first control information. The control corresponding to the control of first system 31 executed according to the first control information includes both control that is the same as the control of first system 31 and control that is approximate to the control of first system 31.

Figure 3:
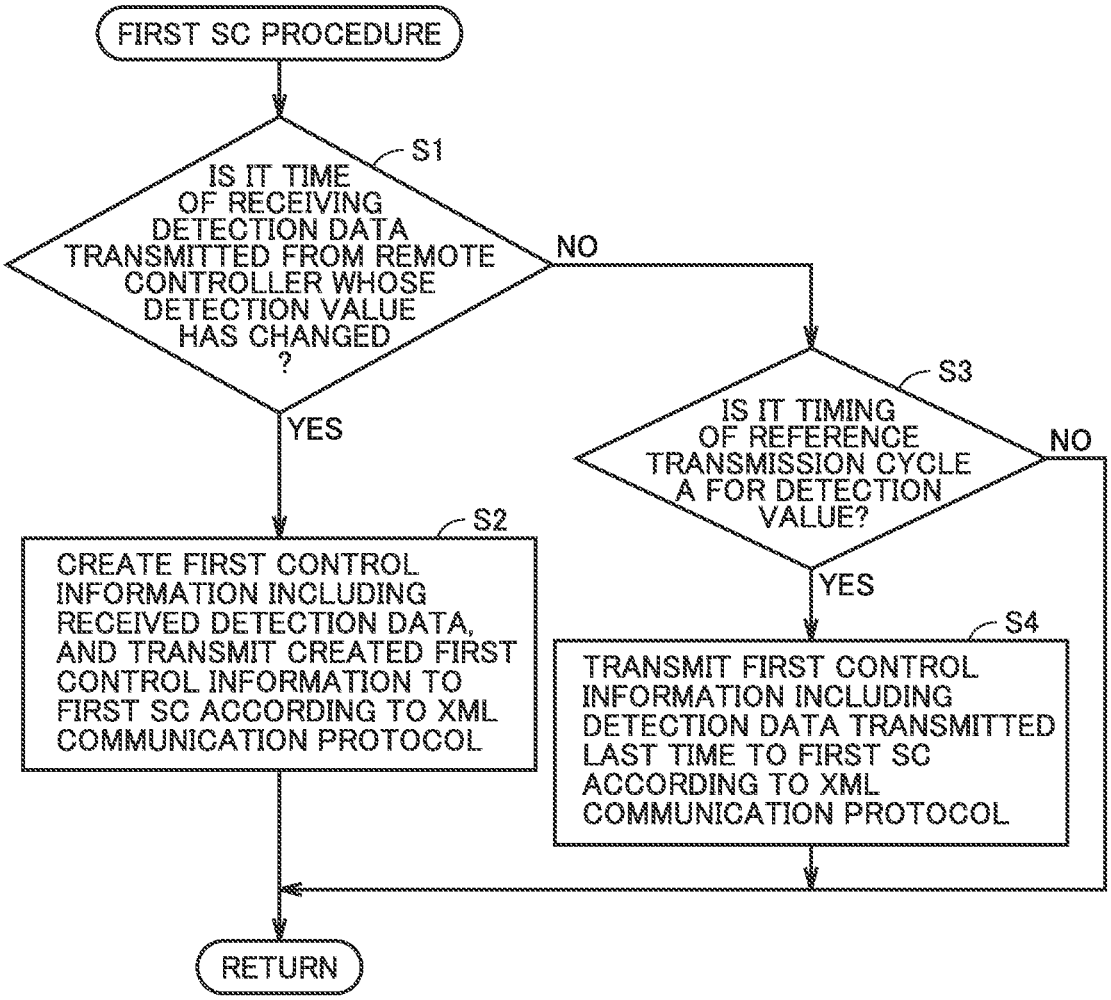
FIG. 3 is a flowchart showing control related to XML, communication executed by a first SC 6 according to the first embodiment.

Next, among the control executed by first SC 6, control related to the XML communication between first SC 6 and second SC 7 will be described. FIG. 3 is a flowchart showing the control related to the XML communication executed by first SC 6 according to the first embodiment.

Referring to FIG. 3, in step S1, it is determined whether or not it is time of receiving room temperature detection data transmitted from remote controller 4 whose detection value of the room temperature sensor has changed. In a case where it is determined in step S1 that it is the time of receiving the detection data, in step S2, the first control information including the received detection data is created, and the created first control information is transmitted to second SC 7 by the XML communication using the XML communication protocol, and the procedure returns.

In a case where it is determined in step S1 that it is not the time of receiving the detection data, in step S3, it is determined whether or not it is transmission timing of a reference transmission cycle A determined in advance for the detection value. If, in step S3, it is determined that it is the transmission timing of reference transmission cycle A, in step S4, the first control information including the detection data transmitted last time is transmitted to second SC 7 by the XML communication using the XML communication protocol, and the procedure returns. On the other hand, if it is determined that it is not the transmission timing of reference transmission cycle A in step S3, the procedure returns.

In first system 31, when the detection value of the room temperature of the sensor in remote controller 4 changes, the detection data is transmitted from remote controller 4 and input to first SC 6 via receiver 5. In first SC 6, every time the detection value of the room temperature of the sensor in remote controller 4 changes, the detection data is input to first SC 6 irregularly. In first SC 6, the first control information including the changed detection data is transmitted to second SC 7 by the XML communication at each timing when the detection value of the room temperature by the sensor in remote controller 4 changes.

In addition, every transmission timing of reference transmission cycle A, first SC 6 transmits the first control information including the detected value of the room temperature at this timing to second SC 7 by the XML communication. In first system 31, since the detection data is transmitted from remote controller 4 when the detection value of the room temperature of the sensor in remote controller 4 changes, the temperature detection value of the room temperature by the sensor of remote controller 4 at the transmission timing of reference transmission cycle A is the temperature detection value of the room temperature transmitted immediately previous of this timing. Therefore, in first SC 6, the detection value is stored every time the temperature detection value of the room temperature of the sensor in remote controller 4 changes, and based on the stored detection, the temperature detection value of the room temperature by the sensor of remote controller 4 at the transmission timing of reference transmission cycle A can be obtained from the detected value of the room temperature transmitted immediately previous of this timing to transmit the first control information including the detection value to second SC 7 by the XML communication.

Next, among the control executed by first SC 6, control related to the XML communication between first SC 6 and second SC 7 and control of the second system executed according to the XML communication will be described.

Figure 4:
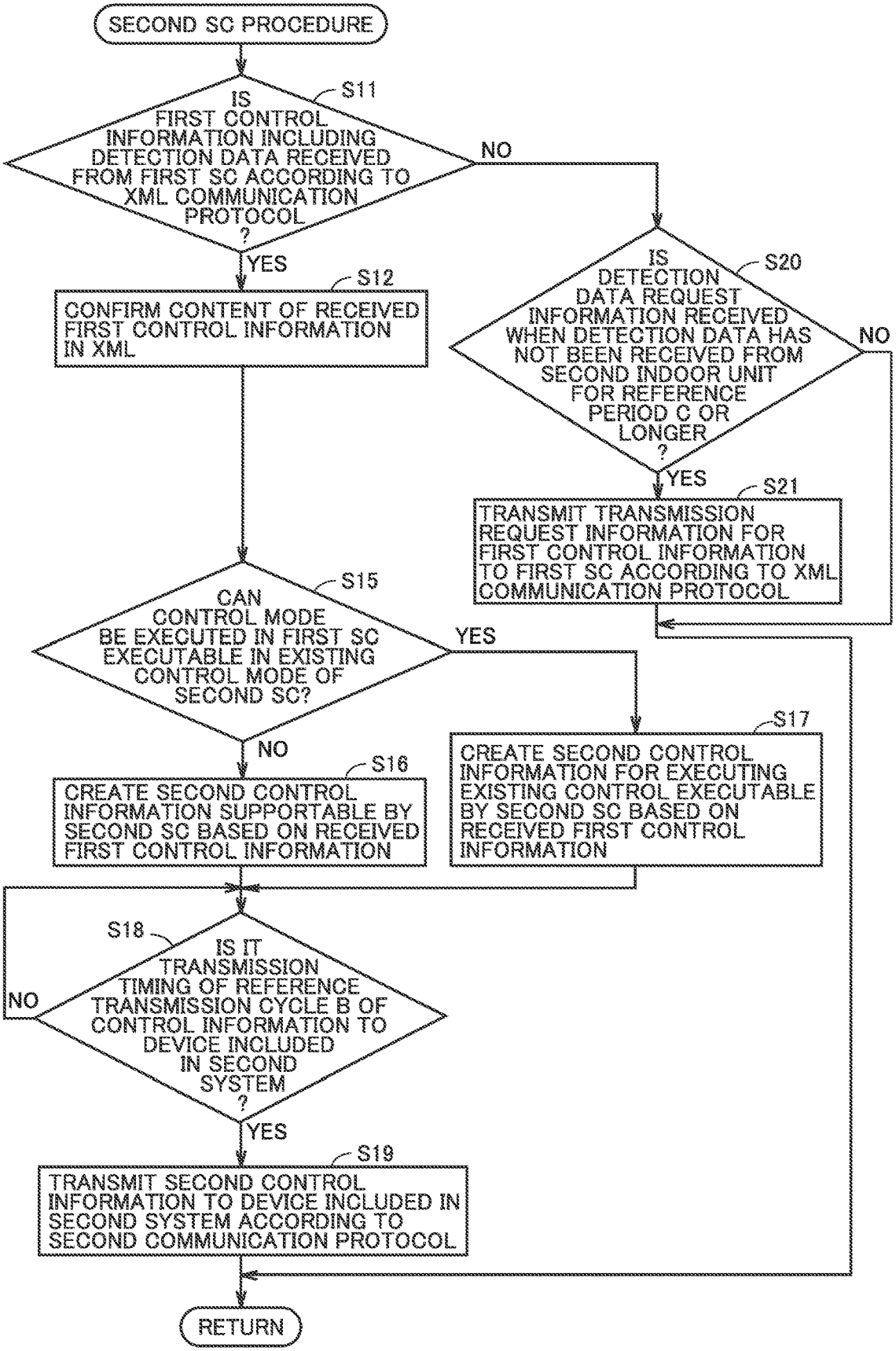
FIG. 4 is a flowchart showing control related to XML communication executed by a second SC 7 and control of a second system executed in accordance with the XML communication according to the first embodiment.

FIG. 4 is a flowchart showing the control related to the XML communication executed by second SC 7 and the control of the second system executed in accordance with the XML communication according to the first embodiment.

Referring to FIG. 4, in step S11, it is determined whether or not the first control information including the detection data has been received by the XML communication protocol from first SC 6. When it is determined that the first control information is received in step S11, content of the received first control information is confirmed in step S12. In step S12, for example, the content of the first control information in which the detection data by the sensor of remote controller 4, the information for specifying the control mode that is being executed, and the information such as an address of first SC 6 as a transmission source of the first control information are described in the XML, language is confirmed.

In step S15, it is determined whether or not the control content of the control mode being executed in first SC 6 confirmed in step S12 can be executed in the existing control mode in second SC 7. If, in step S15, it is determined that the control cannot be executed in the existing control mode in second SC 7, in step S16, the second control information for executing the control supportable by second SC 7 for the control of the control mode confirmed in step S12 based on the received first control state is created, and the procedure proceeds to step S18.

In step S16, the second control information is created as follows, for example. For example, it is assumed that in a case where first SC 6, remote controller 4, and the like have a function of performing control determination using various types of data such as presence-in-room status information, weather forecast information, and materials and materials of an indoor space, for example, a function that can be realized for an abstract request, such as "natural wind", "human body detection", and "quality of sleep", these functions cannot be executed by the corresponding control of the existing control mode alone in second SC 7. In such a case, when the control such as "wind direction/wind speed control", "compressor control", and "temperature control" can be executed as the existing control mode in second SC 7, the second control information is created so that the control corresponding to the control executed in first SC 6 can be executed by combining these existing controls.

Other examples of the procedure in step S16 include the following. In a case where first SC 6, remote controller 4, and the like have abstract control such that "%" is designated in the energy saving control, second SC 7 detects an air volume of second indoor unit 3, and creates the second control information for executing control of changing the air volume up and down in several stages according to the designation of "%" in the energy saving control based on the detection result.

Other examples of the procedure in step S16 include the following. In a case where first SC 6, remote controller 4, and the like have control that can change an air volume in five stages, when second SC 7 can execute control that changes the air volume in three stages, the second control information for executing air volume control in which the air volume control contents in five stages to the air volume control contents in three stages is created.

If, in step S15, it is determined that the control can be executed by the existing control mode stored in second SC 7, in step S17, the second control information for executing the control corresponding to the control of the control mode confirmed in step S12 based on the received first control state by the existing control executable in second SC 7 is created, and the procedure proceeds to step S18.

In step S18, it is determined whether or not it is transmission timing of a reference transmission cycle B of the control information to a device included in second system 32. Reference transmission cycle B is a period shorter than reference transmission cycle A described above. When it is the transmission timing of the control information to the device included in second system 32 in reference transmission cycle B in step S18, the second control information created in step S16 or S17 is transmitted to the device in second system 32 using the second communication protocol in step S19, and the procedure returns.

If, in step S11 described above, it is determined that the first control information is not received, in step S20, it is determined whether or not it is time of receiving detection data request information output from second indoor unit 3 when the detection data has not been received from second indoor unit 3 for a reference period C or longer. Reference period C is a period longer than reference transmission cycle A described above.

When it is determined in step S20 that it is time of receiving the detected data request information, it can be determined that the first control information according to the XML communication protocol has not been received from first SC 6. Therefore, in step S21, information requesting transmission of the first control information is transmitted to first SC 6 according to the XML communication protocol. On the other hand, when it is determined in step S20 that it is not the time of receiving the detection data request information, the procedure returns. When the information requesting transmission of the first control information is received from second SC 7 according to the XML communication protocol, first SC 6 transmits the first control information in the latest control state in response to the received information.

Figure 5:
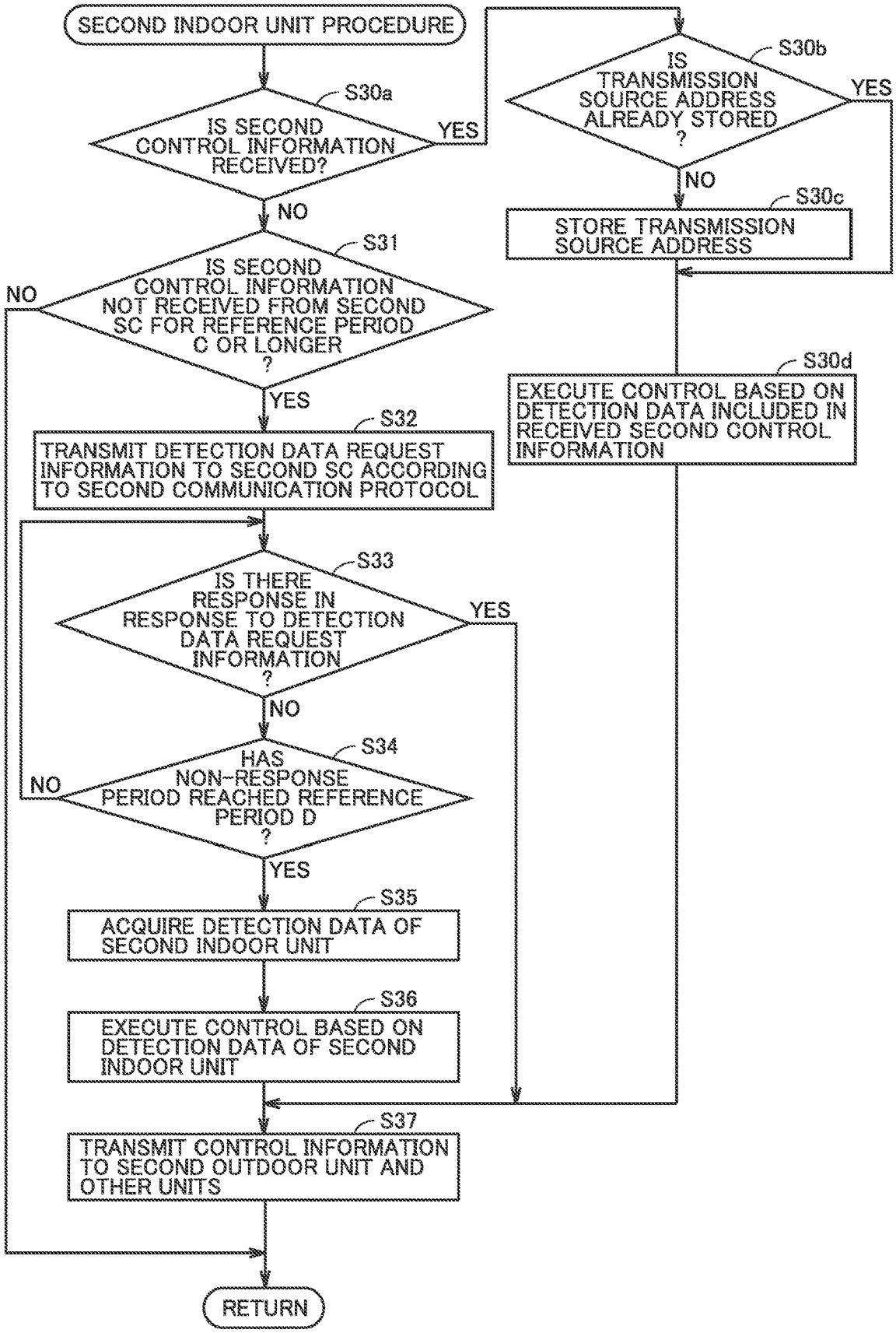
FIG. 5 is a flowchart showing control executed by a second indoor unit 3 according to the first embodiment.

Next, among the control executed by second indoor unit 3, control based on the detection data from first SC 6 transmitted from second SC 7 will be described. FIG. 5 is a flowchart showing control executed by second indoor unit 3 according to the first embodiment.

In step S30*a*, it is determined whether or not the second control information has been received. If it is determined in step S30*a* that the second control information has been received, it is determined in step S30*b* whether or not the address of the transmission source confirmed in step S30*a* is the address of the transmission source already stored in the nonvolatile memory provided in second indoor unit 3. When it is determined in step S30*b* that the address is not the stored address of the transmission source, the transmission source address of the received second control information is stored in the nonvolatile memory in step S30*c*, and the procedure proceeds to step S30*d*. On the other hand, in a case where it is determined in step S30*b* that the address is the stored address of the transmission source, the procedure proceeds to step S30*d*.

In step S30*d*, control based on the detection data included in the received second control information is executed, and the procedure proceeds to step S37.

The reason why the transmission source address of the received second control information is stored in step S30*c* is that, in a case where various devices to be optionally used are provided in second system 32 in addition to the system controller to be used as a standard, information of various sensors included in the device can be used if the device uses the second communication protocol unique to the second system. Examples of devices optionally used in second system 32 include second SC 7, a system controller of a different type, an indoor unit of a different type, and an outdoor unit of a different type.

In such a configuration, second indoor unit 3 performs control to transmit the detection data request information for requesting transmission of the second control information including the detection data to the transmission source address of a target device in a case where the second control information is not received for the reference period or longer that is set to a period longer than the reference cycle in which the second control information is transmitted from the target device with respect to the various devices whose transmission source addresses are stored. Thus, it is possible to continuously perform control based on the detection data even in a case where communication between the various devices whose transmission source addresses are stored and second indoor unit 3 is interrupted.

For example, even when communication between second SC 7 that relays and transmits the detection data from first SC 6 and second indoor unit 3 is temporarily interrupted, the detection data used for control in first SC 6 can be continuously acquired via second SC 7 by transmitting the detection data request information from second indoor unit 3 to second SC 7. Further, even when communication between various devices other than second SC 7 and second indoor unit 3 is temporarily interrupted, it is possible to continuously acquire the detection data used for control in the target device from the target device by transmitting the detection data request information to the target device. As described above, by storing the transmission source address of the second control information received in step S30*a*, it is possible to provide a configuration in which communication is not interrupted when communication for acquiring the detection data from first system 31 by second SC 7 is interrupted and a configuration in which communication is not interrupted when communication for acquiring the detection data from a device optionally provided in the second system is interrupted with the same configuration.

The reason why the address of the transmission source is stored in the nonvolatile memory in step S30*c* is that the address of the transmission source is stored without being erased even after the power supply of second indoor unit 3 is shut off, so that the control can be continuously performed. Examples of the case where communication between second SC 7 and second indoor unit 3 is interrupted include a case where communication cannot be performed since second SC 7 is in a power failure state or a control locked state, a case where wiring between second SC 7 and second indoor unit 3 is disconnected, a case where second indoor unit 3 is in an instantaneous power failure, a case where second indoor unit 3 is temporarily reset, and a case where only second indoor unit 3 is in a power failure. Even in such cases, if the address of the transmission source is stored in the nonvolatile memory in step S30*c*, when the state is restored to the communicable state, the interrupted control can be continuously executed based on the address of the transmission source stored in the nonvolatile memory.

If it is determined in step S30*a* that the second control information has not been received, it is determined in step S31 whether or not it is a state in which the detection data transmitted from second SC 7 to second indoor unit 3 has not been received for reference period C or longer based on the detection data to be received by second SC 7 according to the XML, communication protocol from first SC 6. Reference period C is a period set to be longer than reference transmission cycle A. Reference period C is used as a reference period for requesting second SC 7 to transmit the first control information to the address of the transmission source when the first control information is not transmitted for a period longer than reference transmission cycle A. When it is determined in step S31 that it is not a state in which the detection data has not been received for reference period C or longer, the procedure returns. On the other hand, when it is determined in step S31 that it is the state in which the detection data has not been received for reference period C or longer, the detection data request information requesting transmission of the detection data is transmitted to second SC 7 using the second communication protocol.

Next, in step S33, it is determined whether or not there is a response indicating that the detection data is transmitted from second SC 7 in response to the transmission of the detection data request information. When the response is received from second SC 7 in step S33, the procedure proceeds to step S37 described later. On the other hand, when there is no response from second SC 7 in step S33, it is determined in step S34 whether or not a non-response period for the transmission of the detected data request information has reached a reference period D.

When it is determined in step S34 that the non-response period for the transmission of the detected data request information has not reached reference period D, the procedure returns to S33, and the procedures of S33 and S34 are repeated. The non-response period for the transmission of the detection data request information is measured by a non-response period timer provided in the RAM. When it is determined in step S34 that the non-response period for the transmission of the detection data request information has reached reference period D, the detection data detected by the temperature sensor included in second SC 7 itself is acquired in step S35.

Next, in step S36, control based on the detection data of second indoor unit 3 acquired in S35 is executed, and the procedure proceeds to S37. In S37, the control information is transmitted from second indoor unit 3 to second outdoor unit 82 and the like using the second communication protocol, and the procedure returns. In S37, for example, when the detection data has changed from the detection data acquired last time, control information indicating that the detection data has changed is output.

Next, an outline of a flow of control information from remote controller 4 to second indoor unit 3 in the first embodiment will be described.

Figure 6:
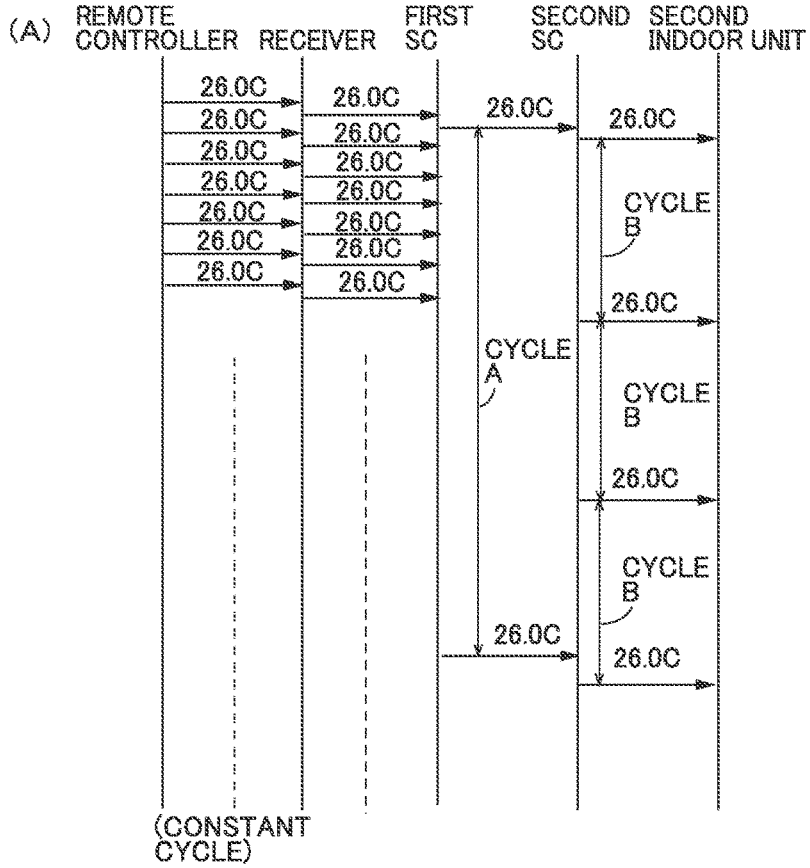
FIG. 6 is a sequence diagram illustrating a flow of control information in a case where detection data of temperature by a remote controller 4 is constant.
Figure 6:
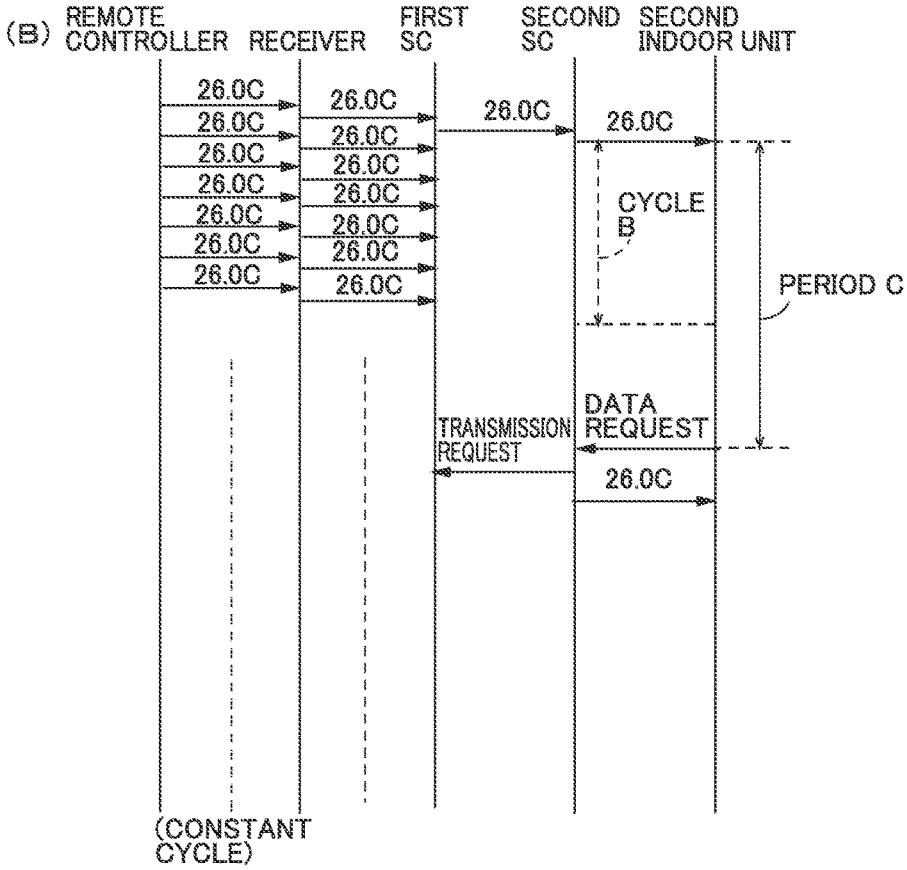

FIG. 6 is a sequence diagram illustrating the flow of the control information in a case where the detection data of temperature by remote controller 4 is constant. In FIG. 6, an example of the temperature indicated by the detection data to be transmitted (for example, 26.0° C.) is illustrated corresponding to an arrow indicating the transmission state of the detection data of the temperature. FIG. 6 illustrates an example in which the detection data of the temperature in remote controller 4 is constant.

FIG. 6(A) illustrates a state in which the communication is normally executed between first SC 6 and second SC 7. FIG. 6(B) illustrates a state in which an abnormality has occurred in the communication between first SC 6 and second SC 7.

Referring to FIG. 6(A), the detection data of the temperature is transmitted from remote controller 4 at a constant cycle according to the first communication protocol. Receiver 5 receives the detection data transmitted from remote controller 4. First SC 6 transmits the detection data received by receiver 5 to second SC 7 at constant reference transmission cycle A according to the XML communication protocol. Second SC 7 transmits the detection data received from first SC 6 to second indoor unit 3 in reference transmission cycle B according to the second communication protocol.

Referring to FIG. 6(B), for example, when the detection data transmitted from first SC 6 to second SC 7 according to the XTML communication protocol is interrupted, the detection data is not transmitted from second SC 7 to second indoor unit 3. When the state in which the detection data is not transmitted from second SC 7 to second indoor unit 3 continues for reference period C, the detection data request information is transmitted from second indoor unit 3 to second SC 7 according to the second communication protocol. Upon reception of the detected data request information, second SC 7 transmits the transmission request information of the first control information to first SC 6 according to the XML communication protocol. In first SC 6 that has received such transmission request information, the first control information including latest detection data (for example, 26.0° C.) is transmitted to second SC 7 according to the XML communication protocol.

Figure 7:
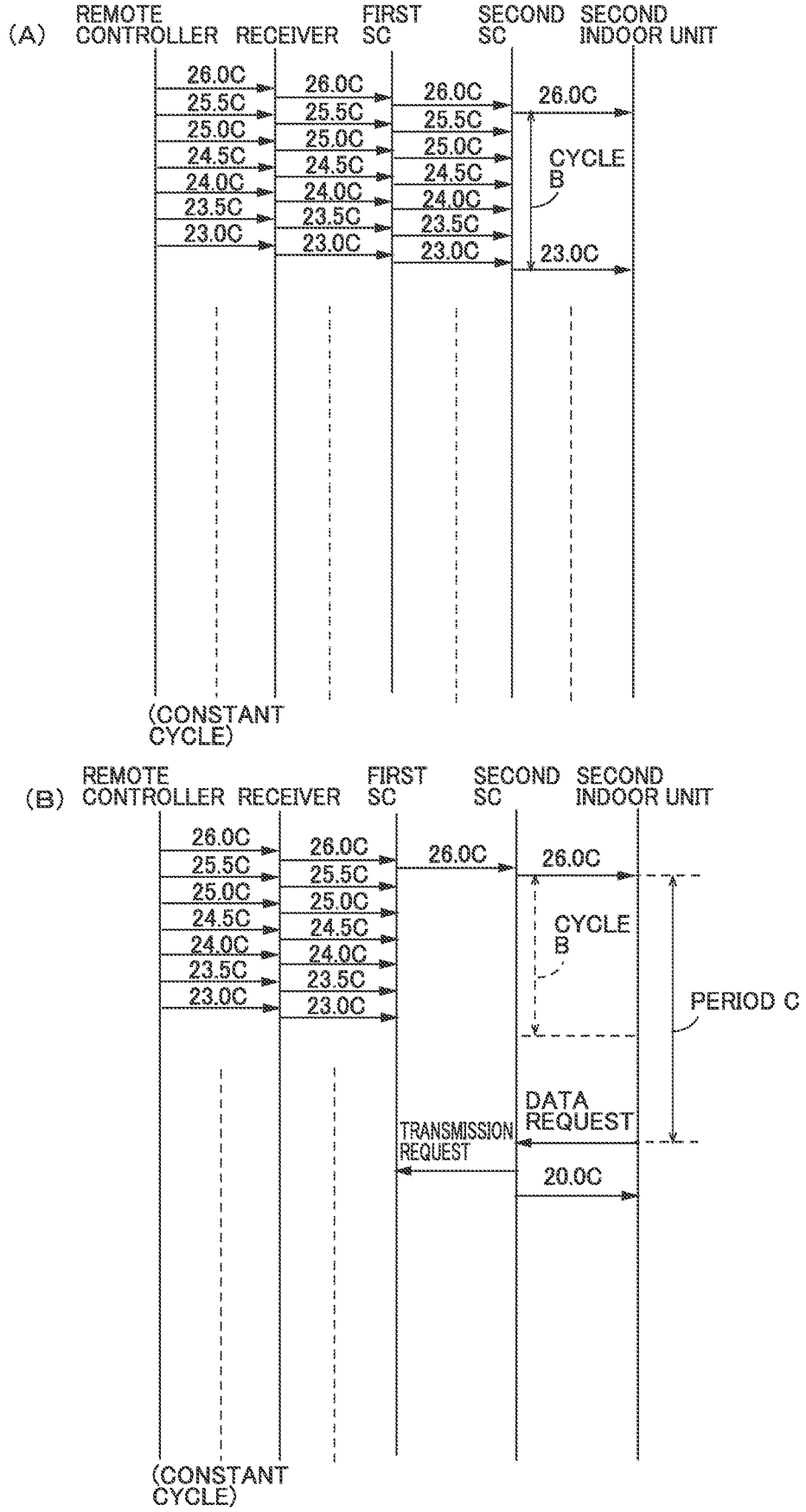
FIG. 7 is a sequence diagram illustrating a flow of control information in a case where detection data of temperature by remote controller 4 changes.

FIG. 7 is a sequence diagram illustrating a flow of control information in a case where the detection data of the temperature by remote controller 4 changes. In FIG. 7, an example of the temperature indicated by the detection data to be transmitted (for example, such as 26.0° C.) is illustrated corresponding to an arrow indicating the transmission state of the detection data of the temperature. FIG. 7 illustrates an example in which the detection data of the temperature in remote controller 4 decreases.

FIG. 7(A) illustrates a state in which the communication is normally executed between first SC 6 and second SC 7. FIG. 7(B) illustrates a state in which an abnormality has occurred in the communication between first SC 6 and second SC 7.

Referring to FIG. 7(A), the detection data of the temperature is transmitted from remote controller 4 at a constant cycle according to the first communication protocol. Receiver 5 receives the detection data transmitted from remote controller 4. First SC 6 transmits the detection data to second SC 7 every time receiver 5 receives detection data having a different detection value according to the XML communication protocol. Second SC 7 receives a large number of pieces of detection data in a short period of time, and transmits the detection data received from first SC 6 to second indoor unit 3 in reference transmission cycle B according to the second communication protocol.

Referring to FIG. 7(B), for example, when the detection data transmitted from first SC 6 to second SC 7 according to the XTML communication protocol is interrupted, the detection data is not transmitted from second SC 7 to second indoor unit 3. When the state in which the detection data is not transmitted from second SC 7 to second indoor unit 3 continues for reference period C, the detection data request information is transmitted from second indoor unit 3 to second SC 7 according to the second communication protocol. Upon reception of the detected data request information, second SC 7 transmits the transmission request information of the first control information to first SC 6 according to the XML communication protocol. In first SC 6 that has received such transmission request information, the first control information including latest detection data (20.0° C.) is transmitted to second SC 7 according to the XML communication protocol.

According to the first embodiment described above, second SC 7 acquires the first control information used for controlling first system 31 from first SC 6 by the XML communication using the XML communication protocol, creates the second control information for causing second system 32 to execute the control corresponding to the control of first system 31 executed according to the first control information based on the first control information acquired by the XML communication, and controls second system 32 by the second communication protocol based on the created second control information. Therefore, it is possible for one second system 32 to easily execute the control corresponding to the control executed by other first system 31. In this case, since the second communication protocol used for controlling second system 32 is a protocol different from the first communication protocol used for controlling first system 31, even if first SC 6 reads from second SC 7 by the XML communication protocol, it is possible to easily prevent the control content of second system 32 from being analyzed, and it is possible for second system 32 to execute the control corresponding to the control executed by other first system 31 without causing a security problem.

In the first embodiment described above, the data of the temperature detection value has been described as an example of the detection data included in the first control information, but the detection data included in the first control information is not limited to this example, and various types of detection data related to other air conditioning control such as detection data of humidity may be used. Further, the procedures of the determination on whether or not the first control information has not been received in second SC 7 for reference period C or longer and the determination on whether or not the transmission request information of the first control information is to be transmitted may be performed in a manner such that second SC 7 itself determines whether or not the first control information has not been received in second SC 7 for reference period C or longer, and then determines whether or not the transmission request information of the first control information is to be transmitted to first SC 6 when the first control information has not been received for reference period C or longer.

Second Embodiment

In a second embodiment, an example will be described in which the second control information is created using initial control information created in advance, when the first control information is not transmitted by the XML communication for the reference period or longer during the execution of the control based on the second control information created based on the first control information.

Figure 8:
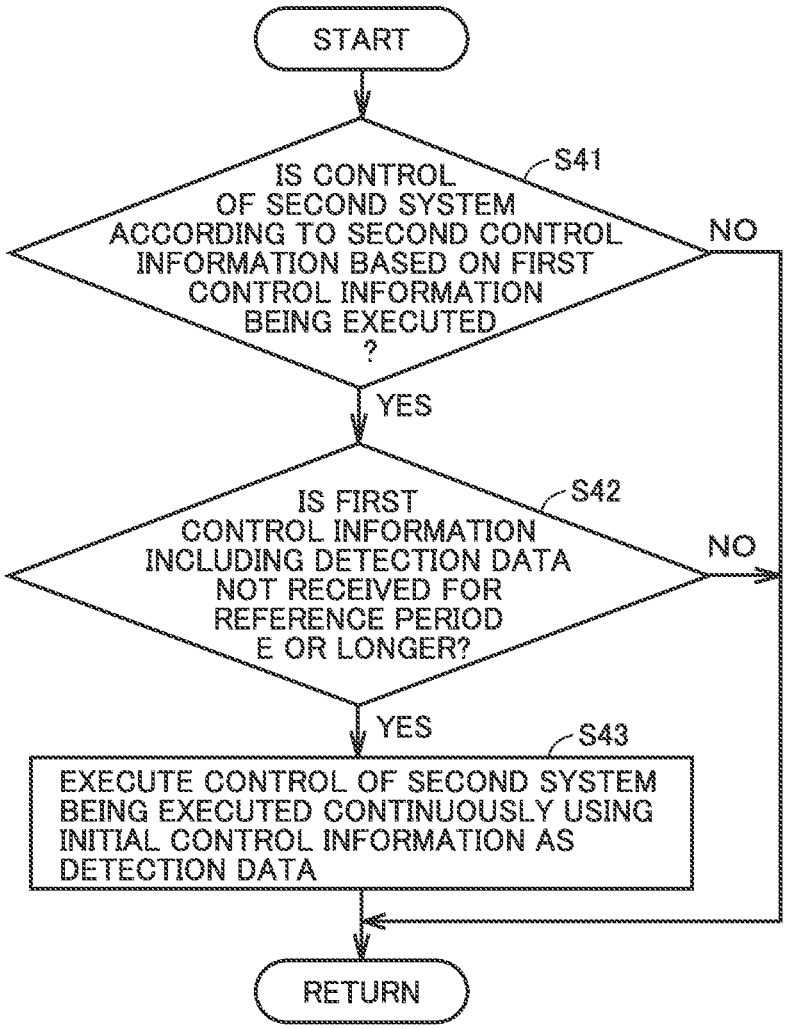
FIG. 8 is a flowchart of initial value control according to a second embodiment.

FIG. 8 is a flowchart of initial value control according to the second embodiment. The initial value control is to control second system 32 using predetermined initial value information when the first control information is not transmitted from first SC 6 for the reference period or longer in the control related to the XML communication executed by second SC 7 and the control of second system 32 executed in accordance with the XML communication.

Referring to FIG. 8, in step S41, it is determined whether or not control of second system 32 according to the second control information based on the first control information is being executed. When it is determined in step S41 that the control of second system 32 is not being executed, the procedure returns. On the other hand, when it is determined in step S41 that the control of second system 32 is being executed, it is determined in step S42 whether or not it is a state in which the first control information including the detection data has not been received for a reference period E or longer. The period during which the first control information is not received is measured by a non-reception period timer provided in the RAM.

In a case where it is determined in step S42 that it is the state in which the first control information including the detection data has not been received for reference period E or longer, in step S43, the control of second system 32 being executed is continuously executed using the initial control information including a predetermined initial value of the control as the detection data, and the procedure returns. On the other hand, when it is determined that it is not the state in which the first control information including the detection data has not been received for reference period E or longer, the procedure returns.

An example of the initial control information used in step S43 is as follows. For example, in the control of the wind speed, among three control values of weak wind, intermediate wind, and strong wind, a control value of the strong wind is set as the initial control information. Further, for example, in the control of the wind direction, among three control values of downward blow, intermediate blow, and upward blow, a control value of the downward blow is set as the initial control information.

According to the initial value control as described above, even in a state where the communication between the first control device (first SC 6) and the second control device (second SC 7) is interrupted, it is possible to continuously execute the control being executed based on the second control information without interruption by creating the second control information using the initial control information.

Third Embodiment

In a third embodiment, an example will be described in which prediction control in which second system 32 is controlled by the second communication protocol based on prediction control information created by predicting the first control information to be next received based on the past first control information in a case where the first control information to be next received is not received by the XML communication when next second control information is created in a case where control according to the second control information based on the first control information transmitted from first SC 6 is being executed will be described.

In the third embodiment, a case where the first control information is transmitted from first SC 6 to second SC 7 every reference timing, and the second control information is created based on the first control information received for every predetermined reference timing is assumed.

Figure 9:
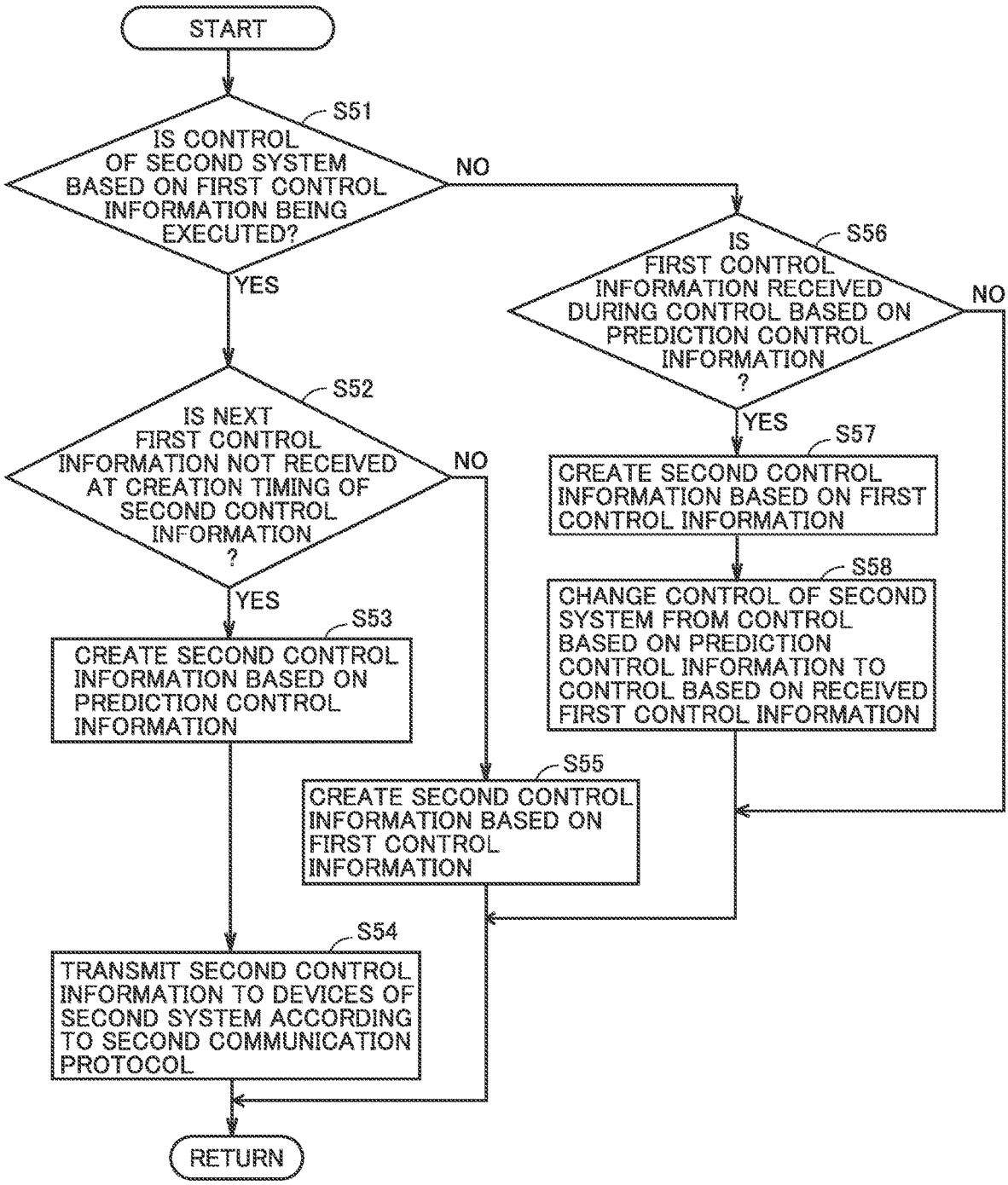
FIG. 9 is a flowchart of prediction control executed by second SC 7 according to a third embodiment.

FIG. 9 is a flowchart of prediction control executed by second SC 7 according to the third embodiment. Second SC 7 executes the following processing as the prediction control.

Referring to FIG. 9, in step S51, it is determined whether or not control of second system 32 according to the second control information based on the first control information is being executed. In a case where it is determined in step S51 that the control of second system 32 according to the second control information based on the first control information is being executed, it is determined in step S52 whether or not the next first control information has not been received at the creation timing of the second control information for each reference timing.

In a case where the next first control information has not been received at the creation timing of the second control information for each reference timing in step S52, it is considered that a delay or the like in the XML, communication from first SC 6 to second SC 7 has occurred. In such a case, since the second control information cannot be created based on the received first control information, in step S53, the first control information to be received next is predicted based on the past first control information, and the second control information is created based on the predicted first control information. The second control information created in this manner is called prediction control information.

After the prediction control information is created in step S53, in step S54, transmission is performed according to the second communication protocol using the second control information as the prediction control information included in second system 32 to the devices such as second indoor unit 3 and second outdoor unit 82 in second system 32, and the procedure returns. As a result, second system 32 is controlled based on the second control information as the prediction control information.

In a case where it is determined in step S51 described above that the control of second system 32 according to the second control information based on the first control information is not being executed, it is determined in step S56 whether or not the next first control information has been received from first SC 6 by the XML communication during the control of the second system based on the prediction control information as the second control information.

When it is determined in step S56 that the first control information has not been received, the procedure returns. On the other hand, when it is determined in step S56 that the first control information is received, the second control information is created based on the received first control information in step S57. Then, in step S58, the control of the second system is changed from the control based on the prediction control information to the control based on the second control information created based on the received first control information, and the procedure returns.

According to the prediction control as described above, even in a case where a delay occurs in the XML communication between first SC 6 and second SC 7, the interruption of the control being executed is suppressed based on the execution of the control based on the prediction control information, and when second SC 7 receives the first control information thereafter, the second system is controlled by the second communication protocol based on the second control information created based on the received first control information. Therefore, it is possible to execute control in accordance with reality based on the second control information created based on the actual first control information without depending on the prediction control.

In the prediction control as described above, when second SC 7 receives the next first control information while the control based on the prediction control information is being executed, the control using the control value of the prediction control may be continuously executed if there is little difference between the control value of the prediction control and the control value included in the next first control information.

Fourth Embodiment

In a fourth embodiment, an example will be described in which in a case where second SC 7 creates the second control information based on the first control information, second SC 7 creates the second control information based on the information regarding the control being executed in second SC 7 in addition to the first control information acquired by the XML communication between first SC 6 and second SC 7.

In the control of the fourth embodiment, for example, when the second control information supportable by second SC 7 is created based on the received first control information in step S16 of second SC procedure in FIG. 4, the second control information may be created based on the information regarding the control being executed by second SC 7 in addition to the first control information. As described above, as a concept of control, the control of the fourth embodiment is included in the procedure of creating the second control information supportable by second SC 7 based on the received first control information in step S16 of the second SC procedure in FIG. 4.

As an example in the fourth embodiment of creating the second control information based on the information related to the control being executed in second SC 7 in addition to the received first control information, when the first control information is the control related to the "quality of sleep" and the control being executed in second SC 7 is the "wind direction/wind speed control", for example, the second control information for executing the "wind direction/wind speed control" involved in the control related to the quality of sleep may be created in addition to the control related to the "quality of sleep", and second system 32 may be controlled based on this second control information. By executing such control, second SC 7 can execute not only the control dependent on the control executed by first SC 6 but also new control in which the control executed by second SC 7 is added to the control executed by first SC 6.

In the fourth embodiment, when the second control information is created based on the information related to the control being executed in second SC 7 in addition to the received first control information, not only second system 32 but also first system 31 may be controlled based on the created second control information. For example, an agreement for controlling first system 31 based on the control information received by first SC 6 is set between first SC 6 and second SC 7, when second system 32 converts the control content based on the second control information created as described above into the control information recognizable by first SC 6 and transmits this control information to first SC 6 by the XML communication. Then, in a case where the second control information is created based on the information related to the control being executed in second SC 7 in addition to the received first control information, control of converting the second control information into control information recognizable by first SC 6 and transmitting the control information to first SC 6 by the XML, communication may be executed in the second SC procedure in FIG. 4. By executing such control, in a case where the second control information is created based on the information related to the control being executed in second SC 7 in addition to the first control information received by second SC 7 from first SC 6, it is possible to control both of second system 32 and first system 31.

SUMMARY OF EMBODIMENTS

The embodiments described above will be described again with reference to the drawings.

The present disclosure relates to air-conditioning system 1 including a second control device (second SC 7) that is communicable with a first control device (first SC 6), the first control device being configured to control first system 31 including a first air-conditioning device (first indoor unit 2, first outdoor unit 81, and the like) by first communication using a first communication protocol, that the second control device being configured to control second system 32 including a second air-conditioning device (second indoor unit 3, second outdoor unit 82, and the like) by second communication using a second communication protocol different from the first communication protocol, wherein the second control device (second SC 7) is communicable with the first control device (first SC 6) by third communication (XML communication) using a third communication protocol (XML communication protocol) different from the first protocol and the second protocol, acquires first control information from the first control device (first SC 6) by the third communication, the first control information being used for controlling the first system (steps S11 and S12), creates second control information based on the first control information acquired by the third communication, the second control information causing the second system to execute control corresponding to control of the first system executed according to the first control information (steps S16 and S17), and controls the second system by the second communication based on the created second control information (step S19).

With such a configuration, the second control device (second SC 7) acquires the first control information used for controlling the first system from the first control device (first SC 6) by the third communication using the third communication protocol (XML communication protocol), creates the second control information for causing second system 32 to execute the control corresponding to the control of first system 31 executed according to the first control information based on the first control information acquired by the third communication, and controls the second system by the second communication based on the created second control information. Therefore, it is possible for one second system 32 to easily execute the control corresponding to the control executed by other first system 31. In this case, since the second communication protocol used for controlling second system 32 is a protocol different from the first communication protocol used for controlling first system 31, even if the first control device (first SC 6) reads from the second control device (second SC 7) by the third communication protocol (XML communication protocol), it is possible to easily prevent the control content of second system 32 from being analyzed, and it is possible for second system 32 to execute the control corresponding to the control executed by other first system 31 without causing a security problem.

Preferably, the second control device (second SC 7) creates the second control information based on the first control information transmitted by the third communication (XML communication) executed at a reference cycle (reference transmission cycle A) (steps S16 and S17), and creates the second control information using initial control information created in advance when transmission of the first control information by the third communication (XML communication) fails for a reference period (reference period E) or longer, during execution of the control based on the second control information that has been created based on the first control information (YES in step S42) (step S43). With such a configuration, for example, even in a state where the communication between the first control device (first SC 6) and the second control device (second SC 7) is interrupted, it is possible to continuously execute the control being executed based on the second control information without interruption by creating the second control information using the initial control information.

Preferably, the second control device (second SC 7) requests the first control device to transmit the first control information (step S20) when transmission of the first control information by the third communication (XML communication) fails for a reference period C or longer (YES in step S31, step S32, and YES in step S20) during the execution of the control based on the second control information that has been created based on the first control information (step S19). With such a configuration, for example, even in a state where the communication between the first control device (first SC 6) and the second control device (second SC 7) is interrupted, it is possible to suppress the interruption of the control being executed based on the second control information and continuously execute the control being executed by requesting the first control device (first SC 6) to transmit the first control information.

Preferably, the second control device (second SC 7) creates the second control information based on the first control information transmitted from the first control device (first SC 6) by the third communication (XML communication) executed in a first reference cycle (reference transmission cycle A) (steps S16 and S17), and controls, based on the created second control information, the second system by the second communication at a second reference cycle (reference transmission cycle B) that is longer than the first reference cycle (steps S18 and S19). With such a configuration, for example, even if the first control information is transmitted from the first control device (first SC 6) to the second control device (second SC 7) at a high frequency, the control cycle in the second control device can be prevented from becoming too short.

Preferably, the second control device (second SC 7) creates the second control information based on the first control information transmitted from the first control device (first SC 6) by the third communication (XML communication) executed in a first reference cycle (reference transmission cycle A) (steps S16 and S17), and controls the second system by the second communication based on prediction control information when reception of the next first control information by the third communication (XML communication) fails at the time of creation of the next second control information in a case where the control based on the second control information created based on the first control information is continuously executed (YES in step S52) (steps S53 and S54), the prediction control information being created by predicting a next first control information based on past first control information, and controls the second system by second communication based on the second control information when the first control information is received by the third communication (XML communication) during execution of the control based on the prediction control information (YES in step S56) (steps S56 and S57), the second control information being created based on the received first control information instead of the prediction control information. With such a configuration, for example, even in a case where a delay occurs in the third communication (XML communication) between the first control device (first SC 6) and the second control device (second SC 7), the interruption of the control being executed is suppressed based on the execution of the control based on the prediction control information, and when the first control information is received thereafter, the second system is controlled by the second communication based on the second control information created based on the received first control information. Therefore, it is possible to execute control in accordance with reality based on the second control information created based on the actual first control information without depending on the prediction control.

Preferably, when the second control information is created based on the first control information (NO in step S15), the second control device (second SC 7) creates the second control information in a case where control executed based on the first control information is not existing as control of the second system (step S16), the second control information being executable by combining existing control of the second system. With such a configuration, even in a case where the control executed based on the first control information is not existing as the control of second system 32, control corresponding to the control executed based on the first control information can be realized by a combination of existing controls.

Preferably, when the second control information is created based on the first control information (first SC 6), the second control device (second SC 7) creates the second control information based on, in addition to the first control information acquired by the third communication, information related to control that is being executed by the second control device (second SC 7) (the fourth embodiment in which in step S16, the second control information is created based on the information related to the control that is being executed by second SC 7, in addition to the first control information acquired by the XML communication between first SC 6 and second SC 7). With such a configuration, the second control device (second SC 7) can execute not only the control dependent on the control executed by the first control information (first SC 6), but also new control in which the control executed by the second control device (second SC 7) is added to the control executed by the first control information (first SC 6).

The embodiments disclosed herein should be considered to be illustrative in all respects and not restrictive. The scope of the present disclosure is defined by the claims instead of the descriptions of the embodiments stated above, and it is intended that meanings equivalent to the claims and all modifications within the scope are included.

The invention claimed is:

1. An air-conditioning system comprising:

a second control device that is communicable with a first control device, the first control device being configured to control a first system including a first air-conditioning device by first communication using a first communication protocol, the second control device being configured to control a second system including a second air-conditioning device by second communication using a second communication protocol different from the first communication protocol, wherein the second control device:

is communicable with the first control device by third communication using a third communication protocol different from the first communication protocol and the second communication protocol, acquires first control information from the first control device by the third communication, the first control information being used for controlling the first system, creates second control information based on the first control information acquired by the third communication, the second control information causing the second system to execute control corresponding to control of the first system executed according to the first control information, and controls the second system by the second communication based on the created second control information.

2. The air-conditioning system according to claim 1, wherein the second control device:

creates the second control information based on the first control information transmitted by the third communication executed at a reference cycle, and creates the second control information using initial control information created in advance when transmission of the first control information by the third communication fails for a reference period or longer, during execution of the control based on the second control information that has been created based on the first control information.

3. The air-conditioning system according to claim 1, wherein the second control device requests the first control device to transmit the first control information when transmission of the first control information by the third communication fails for a reference period or longer, during execution of the control based on the second control information that has been created based on the first control information.

4. The air-conditioning system according to claim 1, wherein the second control device:

creates the second control information based on the first control information transmitted from the first control device by the third communication executed in a first reference cycle, and controls, based on the created second control information, the second system by the second communication at a second reference cycle that is longer than the first reference cycle.

5. The air-conditioning system according to claim 1, wherein the second control device:

creates the second control information based on the first control information transmitted from the first control device by the third communication executed in a first reference cycle, controls the second system by the second communication based on prediction control information when reception of a next first control information by the third communication fails at the time of creation of a next second control information in a case where the control based on the second control information created based on the first control information is continuously executed, the prediction control information being created by predicting a predicted next first control information based on past first control information, and controls the second system by second communication based on the second control information when the first control information is received by the third communication during execution of the control based on the prediction control information, the second control information being created based on the received first control information instead of the prediction control information.

6. The air-conditioning system according to claim 1, wherein when the second control information is created based on the first control information, the second control device creates the second control information in a case where control executed based on the first control information is not existing as control of the second system, the second control information being executable by combining existing control of the second system.

7. The air-conditioning system according to claim 1, wherein when the second control information is created based on the first control information, the second control device creates the second control information based on, in addition to the first control information acquired by the third communication, information related to control that is being executed by the second control device.

8. A control device that is communicable with a first system including a first air-conditioning device and being controlled by first communication using a first communication protocol, wherein the control device controls a second system including a second air-conditioning device by second communication using a second communication protocol different from the first communication protocol, the control device is communicable with the first system by third communication using a third communication protocol different from the first communication protocol and the second communication protocol, the control device acquires first control information from the first system by the third communication, the first control information being used for controlling the first system, and the control device creates second control information based on the first control information acquired by the third communication, the second control information causing the second system to execute control corresponding to control of the first system executed according to the first control information, and the control device controls the second system by the second communication based on the created second control information.

* * * * *